US007248278B1

(12) United States Patent
Carlisle et al.

(10) Patent No.: US 7,248,278 B1
(45) Date of Patent: Jul. 24, 2007

(54) APPARATUS AND METHOD FOR LASER PRINTING USING A SPATIAL LIGHT MODULATOR

(75) Inventors: Clinton B. Carlisle, Palo Alto, CA (US); Jahja I. Trisnadi, Cupertino, CA (US); David T. Amm, Sunnyvale, CA (US); Anthony A. Abdilla, Campbell, CA (US)

(73) Assignee: Silicon Light Machines Corporation, San Jose, CA (US)

( * ) Notice: Subject to any disclaimer, the term of this patent is extended or adjusted under 35 U.S.C. 154(b) by 271 days.

(21) Appl. No.: 10/993,662

(22) Filed: Nov. 19, 2004

Related U.S. Application Data

(60) Provisional application No. 60/528,529, filed on Dec. 10, 2003.

(51) Int. Cl.
*B41J 2/47* (2006.01)

(52) U.S. Cl. ..... 347/239; 347/255

(58) Field of Classification Search ..... 347/237–244, 347/251–258, 135; 372/102, 43.01; 101/401.1; 359/290–291, 29–31, 558–564, 572, 626; 257/414; 385/10
See application file for complete search history.

(56) References Cited

U.S. PATENT DOCUMENTS 6,025,859 A * 2/2000 Ide et al. ..... 347/135
6,084,626 A * 7/2000 Ramanujan et al. ..... 347/239
6,215,579 B1 4/2001 Bloom et al.
6,229,650 B1 5/2001 Reznichenko et al.
6,377,293 B2 4/2002 Koh et al.
6,636,339 B2 10/2003 Lee
6,671,098 B2 * 12/2003 Feldman ..... 359/626
6,728,023 B1 * 4/2004 Alioshin et al. ..... 359/290
6,930,364 B2 * 8/2005 Bruner ..... 257/414
6,934,070 B1 * 8/2005 Maheshwari et al. ..... 359/290
6,947,459 B2 * 9/2005 Kurtz et al. ..... 372/43.01
6,967,986 B2 * 11/2005 Kowarz et al. ..... 372/102
7,027,202 B1 * 4/2006 Hunter et al. ..... 359/291
2003/0221570 A1 * 12/2003 Campbell et al. ..... 101/401.1

OTHER PUBLICATIONS

D.T. Amm, et al. "Grating Light Valve Technology: Update and Novel Applications" May 19, 1998, pp. 1-4. Silicon Light Machines. Presented at Society for Information Display Symposium, Anaheim, CA.

(Continued)

*Primary Examiner*—Hai Pham
(74) *Attorney, Agent, or Firm*—Okamoto & Benedicto LLP

(57) ABSTRACT

The disclosure relates to a printing system having a linear diffractive spatial light modulator (LDSLM) assembly that diffracts light from a laser source according to or under the influence of an applied electric field applied to the LDSLM assembly. In one embodiment, the LDSLM assembly includes a linear array of diffractive MEMS elements. For example, each of the diffractive MEMS elements can include a number of deformable ribbons having a light reflective planar surface. Preferably, the linear array of diffractive MEMS elements including the ribbons and drive electronics are integrally formed on a single substrate. In other embodiments, the LDSM assembly can include two or more linear arrays of diffractive MEMS elements, and the laser source can include an array of multiple lasers or laser emitters.

13 Claims, 12 Drawing Sheets

200

OTHER PUBLICATIONS

David T. Amm, et al. "Optical Performance of the Grating Light Valve Technology" 1999, pp. 1-8, Silicon Light Machines. Presented at Photonics West-Electronics Imaging.

R.W. Corrigan, "An Alternative Architecture for High Performance Display" Nov. 20, 1999, pp. 1-5, Silicon Light Machines. Presented at SMPTE Technical Conference and Exhibition, New York, NY.

R.W. Corrigan, et al. "Calibration of a Scanned Linear Grating Light Valve Projection System" May 18, 1999, pp. 1-4, Silicon Light Machines. Presented at Society for Information Display Symposium, San Jose, CA.

Robert Corrigan, et al. "Silicon Light Machines—Grating Light Valve Technology Brief", Jun. 2001 ver C, pp. 1-8; Sunnyvale, California.

* cited by examiner

100

700

900

APPARATUS AND METHOD FOR LASER PRINTING USING A SPATIAL LIGHT MODULATOR

CROSS-REFERENCE TO RELATED APPLICATIONS

The present application claims the benefit of U.S. provisional application No. 60/528,529, entitled "Apparatus and Method for Laser Printing Using a Spatial Light Modulator," filed Dec. 10, 2003, by inventors Clinton B. Carlisle, Jahja I. Trisnadi, David T. Amm, and Anthony A. Abdilla, the disclosure of which is hereby incorporated by reference.

TECHNICAL FIELD

The present invention is directed generally to a laser printer utilizing spatial light modulators, and more particularly to a laser printer utilizing a linear diffractive spatial light modulator.

BACKGROUND OF THE INVENTION

Conventional laser printers use mechanical scanners to scan a laser spot onto a photosensitive or photoconductive surface. The photosensitive or photoconductive surface may be, for example, on a drum 108. Typical laser printers have scanning optics that include a laser 102 for generating laser light, a multifaceted mirror or scanner 104 that spins at high speed for scanning laser light. A layout for a conventional laser printer 100 is shown in FIG. 1. The printing architecture shown in FIG. 1, often termed a "flying-spot" architecture, is highly effective and permits reasonably high printing speeds over relatively large printing surfaces (e.g. 8.5"×11") with modest (1-10 mW level) laser powers.

However, the limitations of such an approach are equally evident. Scanners require a predetermined time to spin up to operating speed prior to printing a first page, and the spinning speed inherently limits how fast the scanner can scan. The mechanical nature of this scanning mechanism is thus disadvantageous and also leads to increased operating noise and maintenance costs.

Additionally, while conventional scanning optics 106 can be satisfactorily used in a wide variety of printing applications, there are emerging applications that require even higher pixel resolutions than can be provided by the architecture described above.

Accordingly, there is a need for a linear spatial light modulator that exhibits the following characteristics: good analog gray-scale capability, high modulation speed, high diffraction efficiency, and a large number of "channel" count (1000-10,000). There is a further need for a method of manufacturing such a spatial light modulator that is simple, cost-effective, and tolerant of process variations.

SUMMARY OF THE INVENTION

The present disclosure provides a solution to these and other problems, and offers further advantages over conventional laser printers.

In one aspect, the present invention is directed to a printing system having a linear diffractive spatial light modulator (LDSLM) assembly that diffracts light from a laser source according to or under the influence of an applied electric field applied to the LDSLM assembly. Generally, the printing system further includes illumination optics for focusing the light beam onto the LDSLM assembly, an image plane having an array of photosensitive elements or a photosensitive surface, and imaging optics disposed in a light path between the spatial light modulator assembly and the image plane to expand the light beam and impinge the light beam simultaneously on a substantially linear portion of the photosensitive surface.

In one embodiment, the LDSLM assembly includes a linear array of diffractive MEMS elements. For example, each of the diffractive MEMS elements can include a number of deflectable ribbons having a light reflective planar surface. In one version of this embodiment, the LDSLM assembly includes a linear array of diffractive MEMS elements grouped in a number of pixels, and each of the diffractive MEMS elements in a single pixel share a common ribbon structure.

In another embodiment, each of the diffractive MEMS elements further include a substrate on which the ribbons and drive electronics to apply an electric field to the ribbons is integrally formed. Preferably, the linear array of diffractive MEMS elements including the ribbons and drive electronics are integrally formed on a single substrate.

In other embodiments, the LDSM assembly can include two or more linear arrays of diffractive MEMS elements, and the laser source can include an array of multiple lasers or laser emitters.

BRIEF DESCRIPTION OF THE DRAWINGS

These and various other features and advantages of the present invention will be apparent upon reading of the following detailed description in conjunction with the accompanying drawings and the appended claims provided below, where:

The use of the same reference label in different drawings indicates the same or like components. Drawings are not necessarily to scale unless otherwise noted.

DETAILED DESCRIPTION

The present invention is directed to a novel printing system having a linear diffractive spatial light modulator (LDSLM) assembly that diffracts light from a laser source according to or under the influence of an applied electric field applied to the LDSLM assembly.

Figure 1:
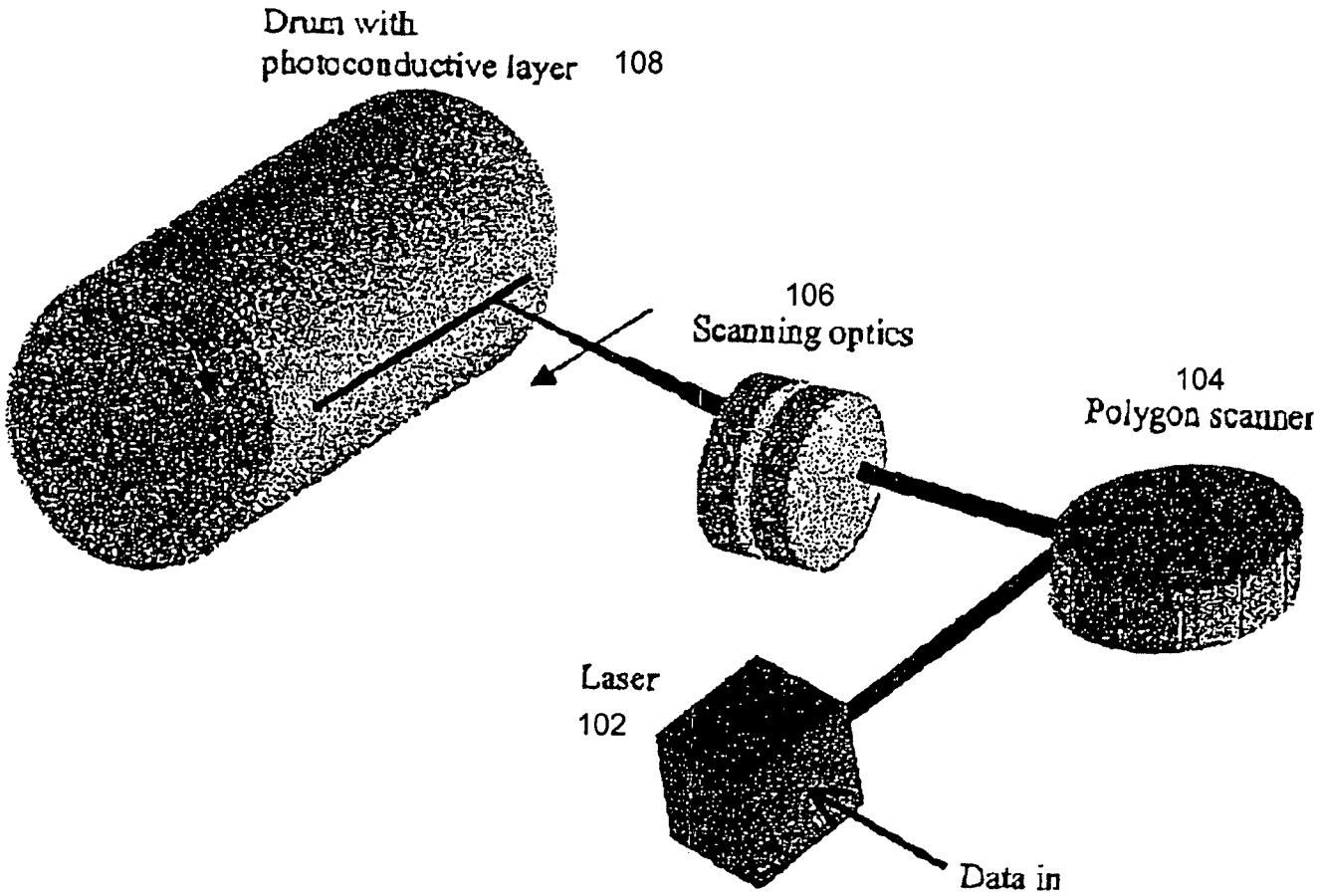
FIG. 1 (Background Art)
FIG. 1 is a schematic block diagram of a layout for a conventional laser printer.
Figure 2:
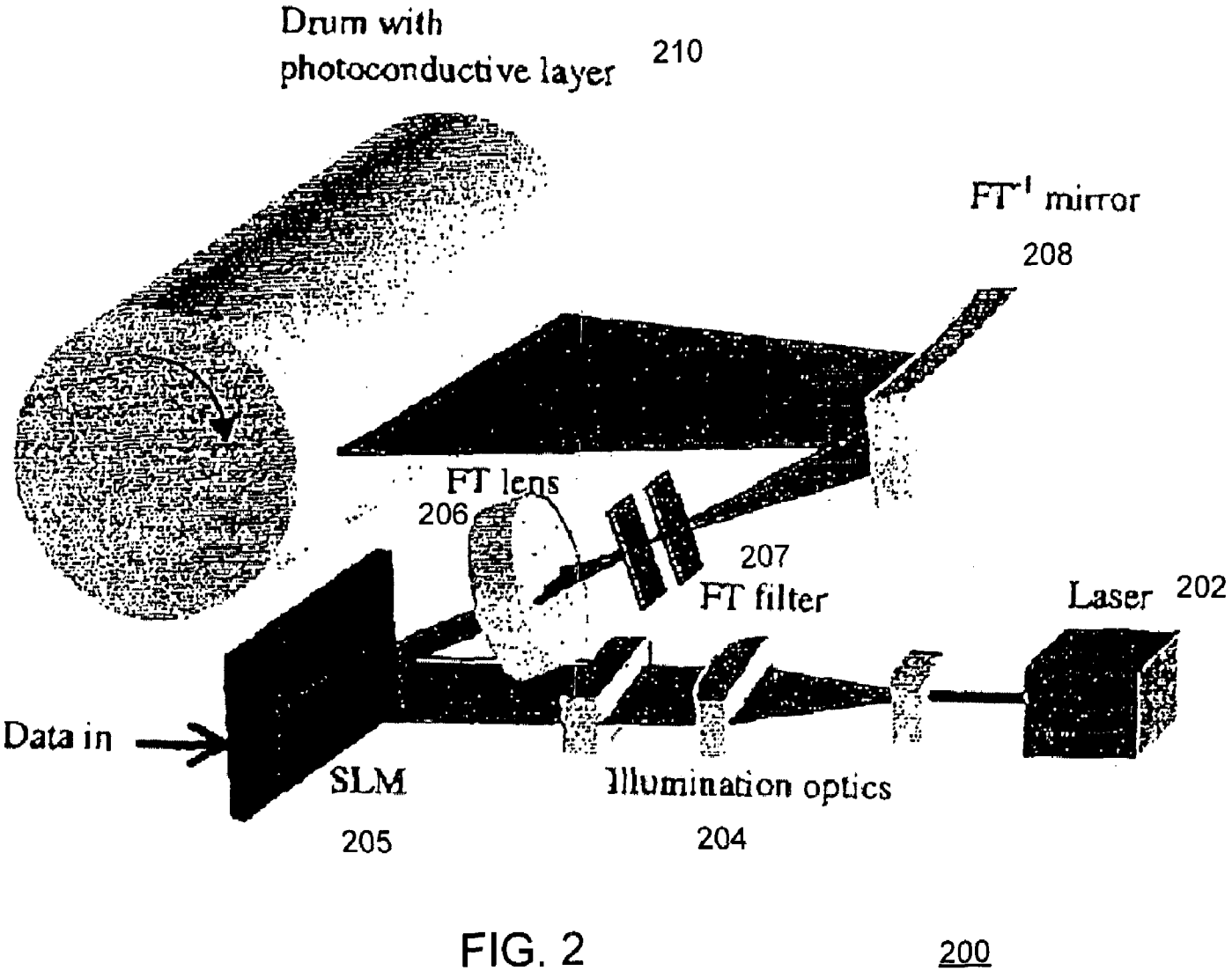
FIG. 2 is a schematic block diagram of a layout for a laser printer having a linear diffractive spatial light modulator assembly according to an embodiment of the present invention.

An architecture 200 for a laser printer according to an embodiment of the present invention is shown in FIG. 2. This printing architecture 200 eliminates the polygonal scan mirror and f-θ or scanning optics and replaces them with a linear diffractive spatial light modulator (LDSLM) 205 with adequate pixel count to cover a swath extending substantially across the entire width of an imaging plane. Generally, the architecture 200 further includes a light or laser source 202, illumination optics 204, and imaging optics having magnification and filtering elements (for example, Fourier transform lens 206, Fourier transform filter 207, and inverse Fourier transform mirror 208) to direct an image from the LDSLM 205 onto a photosensitive or photoconductive surface of the imaging plane.

Referring to FIG. 2, in one embodiment the laser printer includes a laser source 202, illumination optics 204, a LDSLM 205, a FT (Fourier Transform) lens 206, an FT filter 207, a $FT^{-1}$ mirror 208 and a photoconductive layer located on a drum 210. Generally, the LDSLM 205 includes a linear array of a number of individual diffractive MEMS (Micro Electromechanical Systems) elements or diffractors (not shown in this figure). The diffractive MEMS elements may be grouped or functionally linked to provide a number of pixels. For example, in one version of the layout illustrated in FIG. 2, the LDSLM 205 has sufficient number of pixels to cover an entire 8" swath on a standard write drum with 2000 dpi printing resolution using a modest-power, 780 nm GaAs diode laser.

The laser source 202 can include a number of lasers or laser emitters, such as low-power diode lasers, each powered from a common power supply (not shown) in a CW (Continuous Wave) operation.

The illumination optics 204 can comprise a number of elements including lens integrators, mirrors and prisms, designed to transfer light from the laser source 202 to the LDSLM 205 such that a line of a specified size is illuminated at the LDSLM 205. In particular, the illumination optics 204 are adapted to illuminated a swath covering substantially the full width of the LDSLM 205.

The imaging optics can comprise magnification elements, such as the FT lens 206 and mirror 208, and filter elements, such as the FT filter 207, designed to transfer light from the LDSLM 205 to the drum 210 such that the photoconductive layer located on the drum 210 is illuminated across a swath covering substantially the full width of the drum 210.

Some embodiments of diffractive MEMS elements and pixel structures for the diffractive MEMS elements of the LDSLM 205 according to the present invention will now be described with reference to FIGS. 3, 4, 5A and 5B. For purposes of clarity, many of the details of light modulators that are widely known and are not relevant to the present invention have been omitted from the following description. Ribbon light modulators are described in more detail in, for example, in commonly U.S. Pat. No. 5,311,360 to Bloom et al.; and U.S. Pat. No. 5,661,592 to Bornstein et al.

Figure 3:
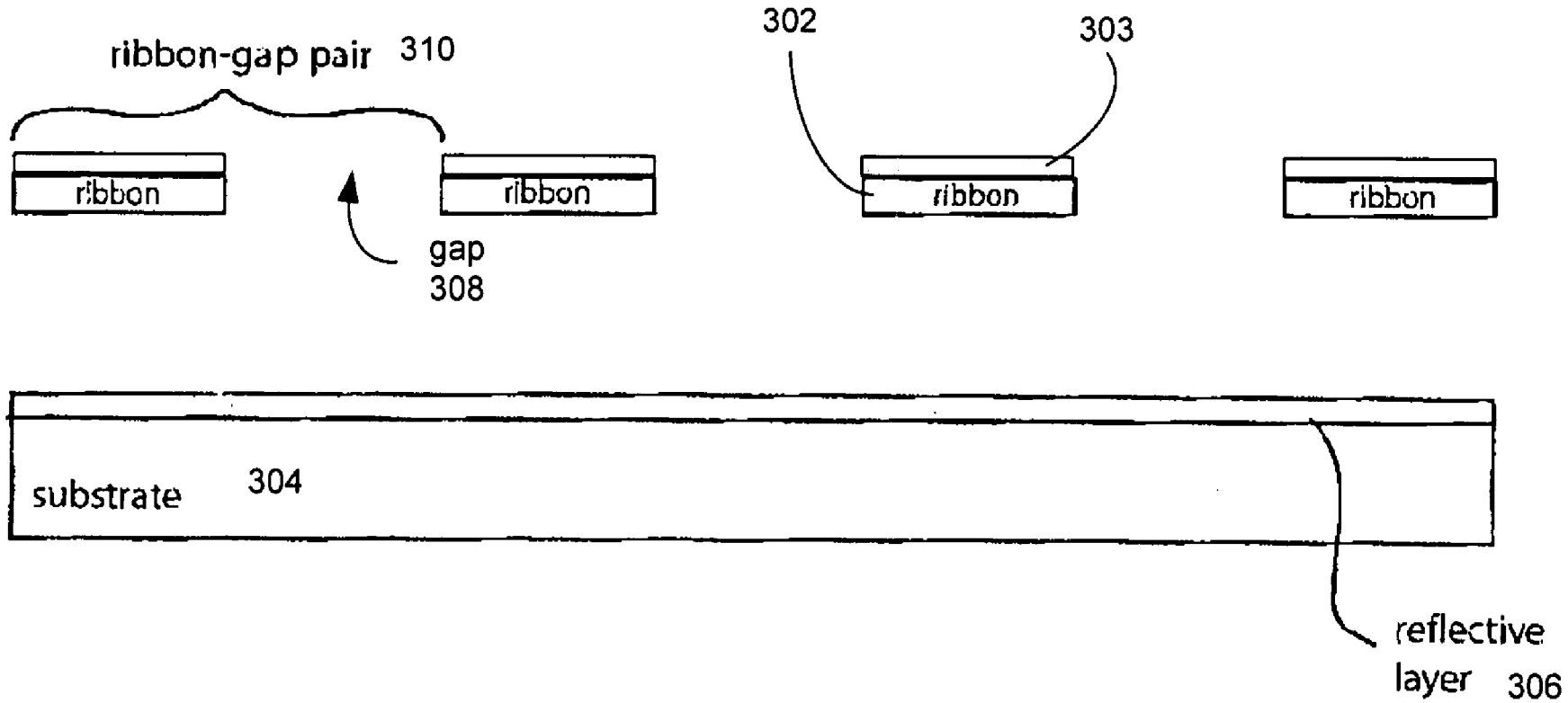
FIG. 3 is a schematic block diagram of a ribbon structure for a diffractive spatial light modulator according to an embodiment of the present invention.

Referring to FIG. 3, in one embodiment the diffractive MEMS elements include a ribbon light modulator, such as a Grating Light Valve™ (GLV™) commercially available from Silicon Light Machines Corporation, of Sunnyvale, Calif. Generally, the ribbon light modulator comprises a number of ribbons 302 each having a light reflective surface 303 supported over a reflective surface 306 of a substrate 304. There are gaps 308 between the ribbons 302. Each ribbon 302 is deflectable toward the substrate 304 to form an addressable diffraction grating with adjustable diffraction strength. The ribbons 302 may be electro-statically deflected towards or away from the substrate 304 by integrated drive electronics formed in or on the surface of the substrate 304.

Figure 4:
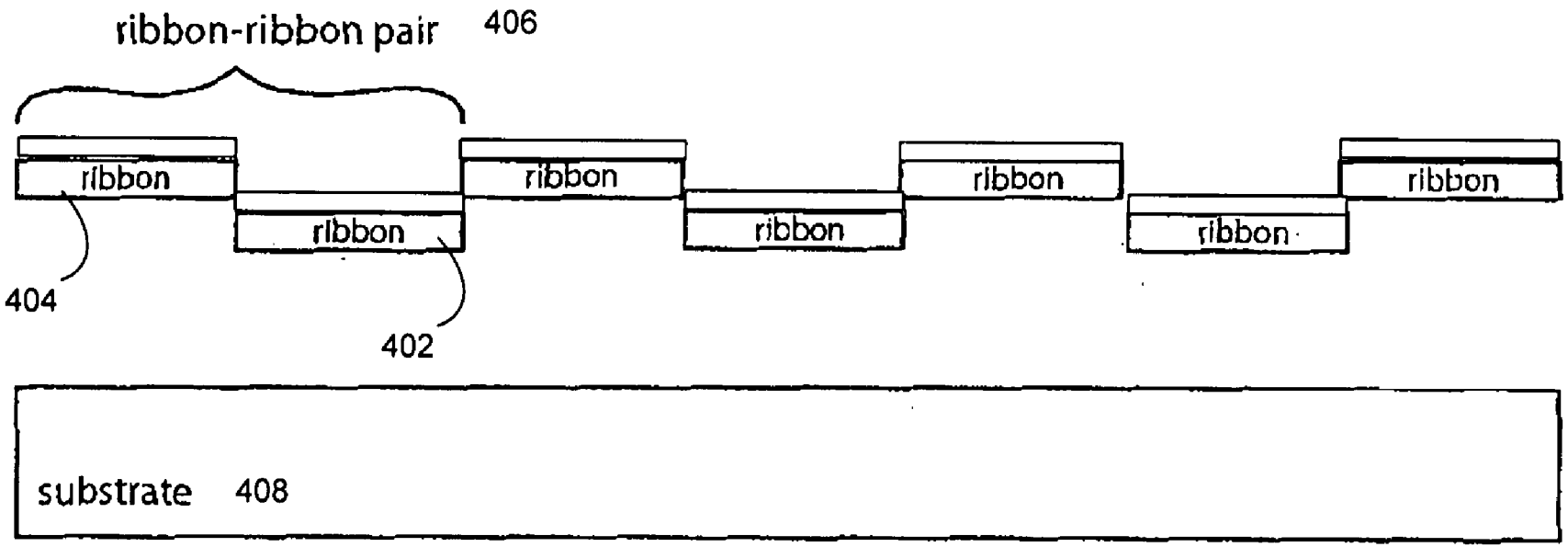
FIG. 4 is a schematic block diagram of a ribbon structure for a diffractive spatial light modulator according to another embodiment of the present invention.

In an alternative embodiment, shown in FIG. 4, a number of static non-deflectable ribbons 404 are interlaced with the electro-statically deflectable ribbons 402.

A ribbon and a gap pair 310 in FIG. 3 or an active ribbon and static ribbon pair 406 in FIG. 4 constitute a diffraction period. Two or more periods can be addressed as a pixel. A pixel can be addressed to modulate incident light by diffraction. Thus, a pixel can be used to display or print a unit of an image on to the photoconductive surface of the drum.

Figure 5A:
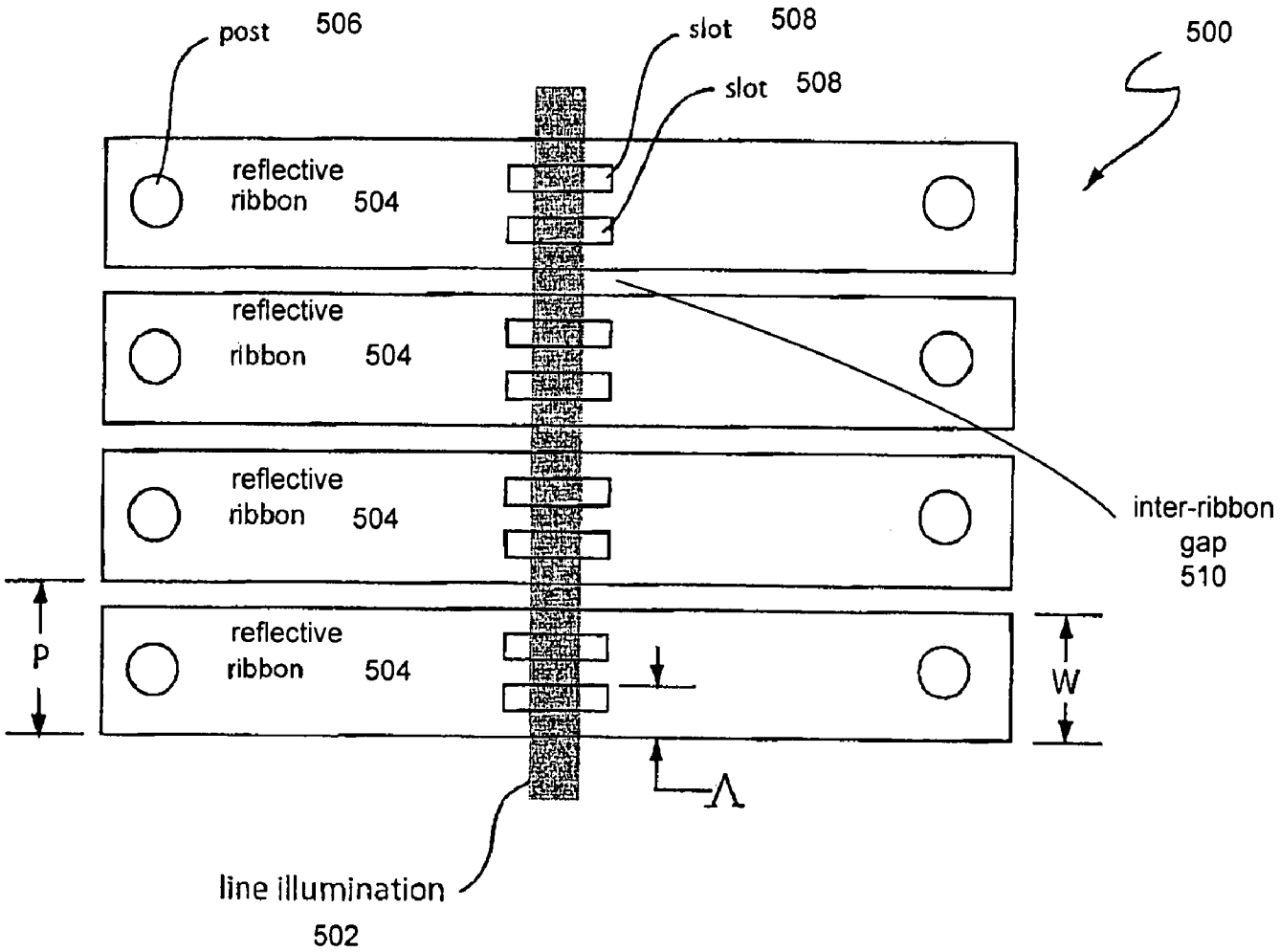
FIG. 5A is a top view of a ribbon structure for pixels of a linear diffractive spatial light modulator according to a preferred embodiment of the present invention.
Figure 5B:
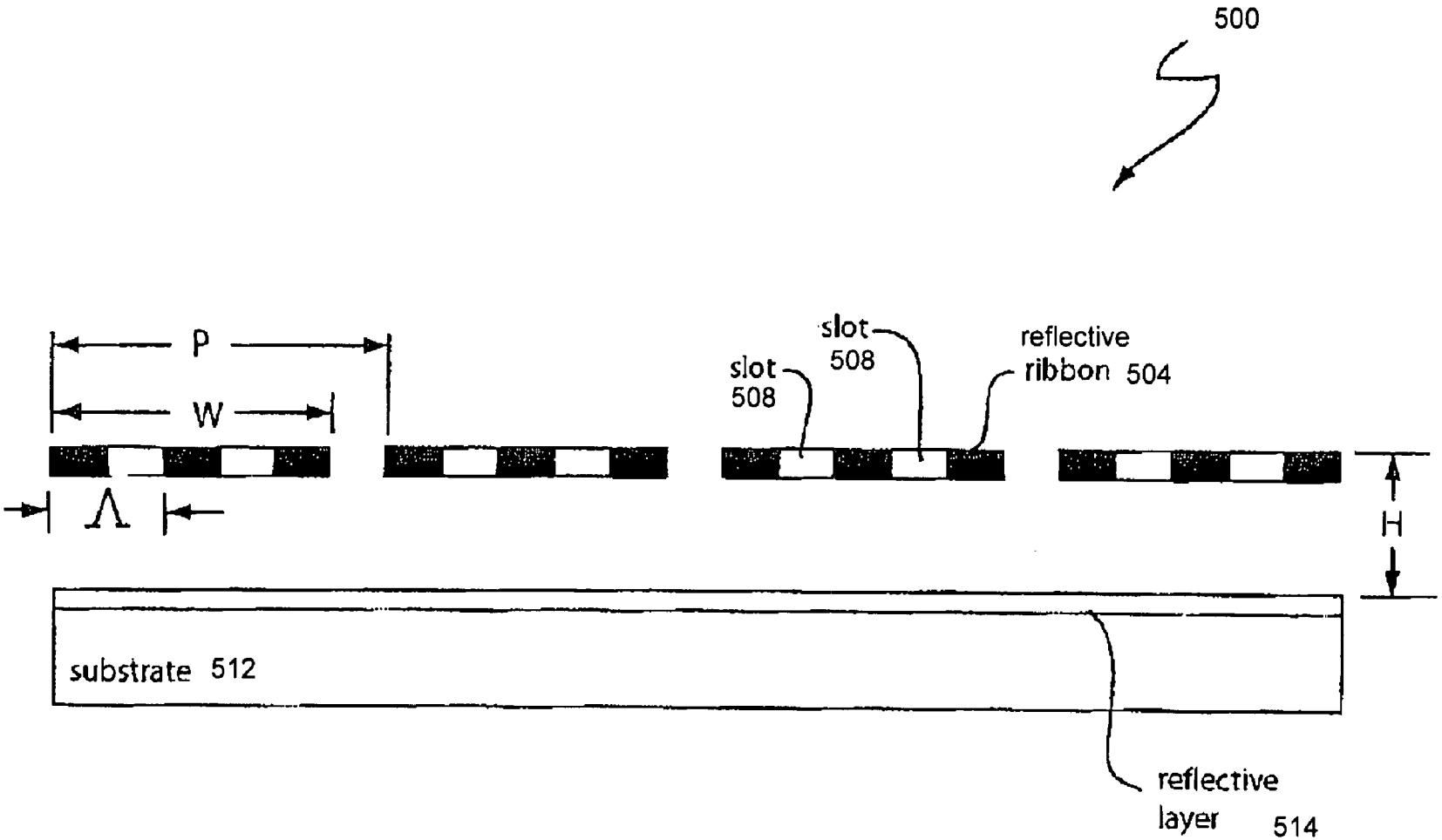
FIG. 5B is a cross-sectional view of a ribbon structure for pixels of a linear diffractive spatial light modulator according to a preferred embodiment of the present invention.

In a preferred embodiment, shown in FIGS. 5A and 5B, the LDSLM 205 involves the use of a very large pixel count, linear, diffractive spatial light modulator 500 that embodies many of the functional characteristics of a GLV™ type SLM. However, it differs from the conventional GLV™ type SLMs in some important aspects: First, all of the diffractive units within a given pixel share the same ribbon structure. Second drive electronics for each pixel are integrated into the same substrate as the MEMS structure, due to the high pixel count and fine pixel pitch. FIGS. 5A and 5B illustrate in greater detail how this is achieved.

Referring to FIGS. 5A and 5B, each ribbon 504 may constitute a pixel, with two or more periods Λ constructed from etched slots 508 in the illuminated region at the center of the ribbon. A period Λ consists of a ribbon-slot or ribbon-gap pair. A pixel P has N periods/pixel (three in the illustrations of FIGS. 5A and 5B), i.e., $P=N\Lambda$. The ribbon width $W=P-\Lambda/2$. The device may be configured such that a line of illumination 502 impinges upon a center portion of the ribbons 504 where the slots 508 are placed. Posts 506 may be used to support the two end portions of each ribbon 504. As shown in FIG. 5B, beneath the ribbons 504 is a substrate 512 with a reflective surface layer 514.

The LDLSM 205 can be operated in zero-order or first-order modes. In the zero-order mode, the $0^{th}$-order diffraction (or reflection) is collected and modulation is obtained by diffracting the light away into first and higher orders. In first-order mode, it is the modulated $1^{st}$-order diffractions that are collected. However, since the LDSLM period is likely to be just a few wavelengths, the diffraction angle is very large. Therefore, zero-order operation is more desirable. The distance between the ribbon reflective layer and the bottom reflective layer is H. If $H=odd\times\lambda/4$, the LDSLM is normally OFF, i.e. the un-activated state is diffracting (so light is discarded), which corresponds to a dark pixel in the $0^{th}$ order mode. If H=even×λ/4, the LDSLM is normally ON, i.e. the un-activated state is specular, which corresponds to a bright pixel in the $0^{th}$ order mode. Since the ribbon snaps down to the substrate if the deflection exceeds H/3, the smallest even (odd) multiplier is four (five). Alternatively, a height margin δ is added to permit uniformity calibration (e.g. 5λ/4+δ).

As an example, Λ=1 μm, N=3, periods/pixel, giving P=3 μm. The slot width as well as the inter-ribbon gap=0.5 μm. The ribbon width is W=2.5 μm. For λ=0.5 μm, a normally off device has a H=0.625 μm (odd=5) or H=0.875 μm (odd=7). Thus, for 10,000 pixels the die is only 30 mm long.

Figure 6:
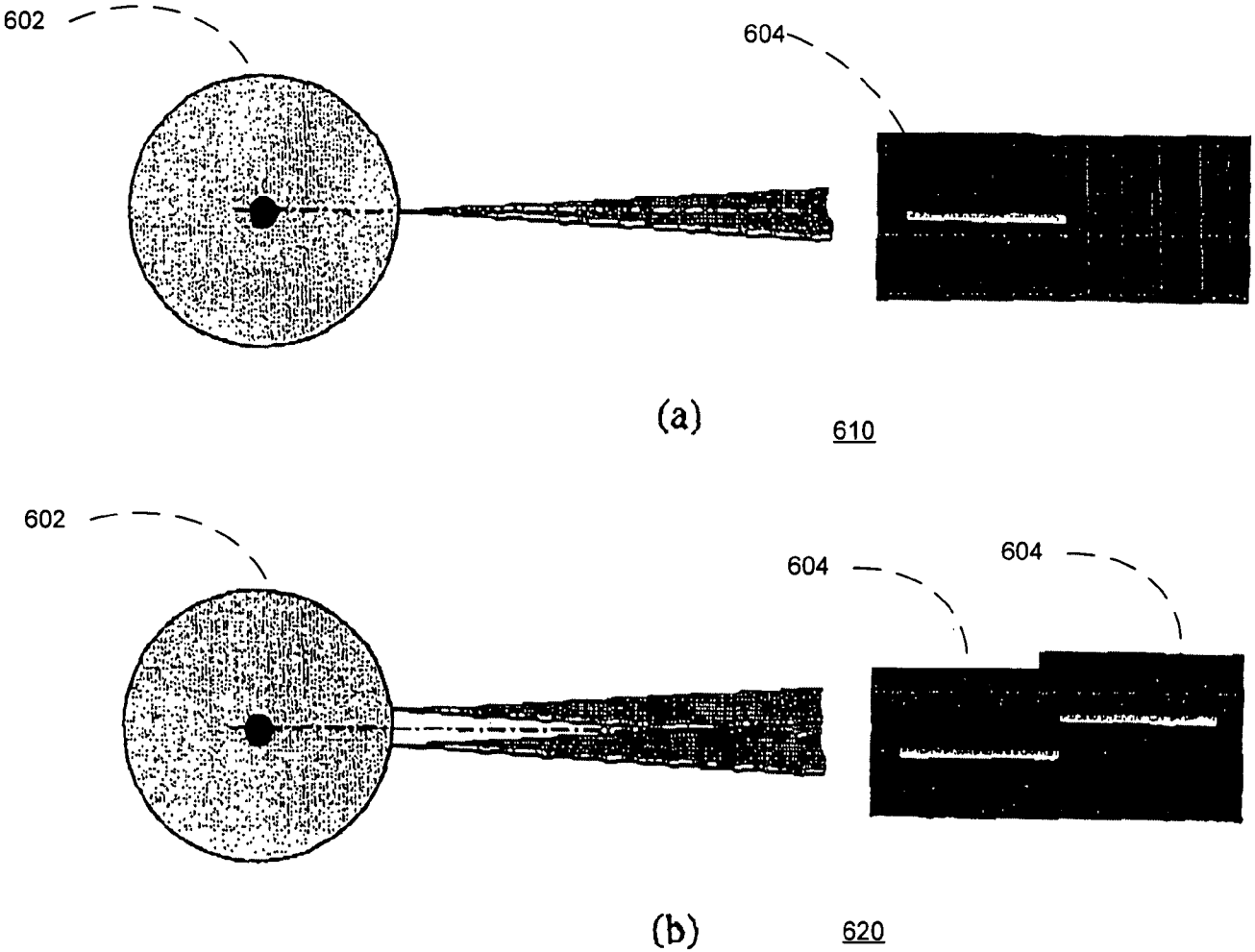
FIG. 6 includes schematic block diagrams of layouts for a laser printer having a linear diffractive spatial light modulator assembly illustrating imaging to a drum in the (a) single modulator configuration, and (b) multi-modulator configuration, where two or more devices are staggered in two symmetrically offset positions according to an embodiment of the present invention.

In yet another aspect of the present invention, the inventive architecture can be scaled to even higher pixel count by employing two or more LDSLMs. Two or more LDSLMs can be employed in two symmetrically offset positions as shown in FIG. 6. FIG. 6 depicts imaging to a drum 602 (a) in a single SLM configuration 610, and (b) in a multiple LDSLM configuration 620. In the multiple LDSLM configuration 620, two or more LDSLM devices 604 may be staggered in two symmetrically offset positions. Preferably, the data sent to each of the LDSLMs 604 is time-delayed appropriately. Although shown as staggered in two symmetrically offset positions, it will be appreciated that such a configuration is not required, and in yet another alternative embodiment the image paths from each of the LDSLMs 604 can be completely separate.

Example

For a diffractive-MEMS-based laser printer using the product architecture 200 illustrated schematically in FIG. 2, computation of possible printing speeds and resolutions allows comparison with conventional flying spot laser printers.

For this example calculation on the printing speeds attainable by the linear, diffractive MEMS-based laser printer, the following system parameters are defined as:

Printing speed=R [area/time]

Photoconductor sensitivity=S [exposure fluence=energy/area]

Optical throughput=η

The desired laser power=P [energy/time]

Laser wavelength=λ=780 nm (GaAs diode laser)

$$P = \frac{RS}{\eta}$$

For example, R=1 letter-size paper/sec=30×20 $cm^2$/s (excluding overhead, such as paper feeding), S=1.5 μJ/$cm^2$ at 800 nm wavelength, η=30%, then P=3 mW.

Resolution=r

Paper width=$W_{paper}$

Paper length=$L_{paper}$

The paper linear speed (hence the drum linear speed) is $$v = \frac{R}{L_{paper}}$$

which, in this example, is 30 cm/sec, and the LDSLM modulation speed is $$R_{GLV} = \frac{v}{r},$$

so at r=12.5 μm (2000 dpi), LDSLM pixel speed=(30 cm/sec)/(12.5 μm)=24 kHz.

The desired number of LDSLM pixels $N_{GLV}$ is $$N_{GLV} = \frac{W_{paper}}{r},$$

so at r=12.5 μm (2000 dpi) and $W_{paper}$=8"=200 mm, $N_{GLV}$=16000.

To maintain a reasonable die size for that many pixels, the pixel size w is preferably small (a few microns). The optics magnification will then be $$M = \frac{r}{w}.$$

With the slotted ribbon diffractive LDSLM described earlier, 3 μm pixels become feasible. In this case, the optics magnification is M=12.5/3=4.17×

The desired illumination-optics speed is $$NA_{illum} = \frac{\lambda}{w},$$

which in the example is $NA_{illum}$=0.78/3=0.27 (F/1.8).

The desired imaging optics speed is $$NA_{img} = \frac{\lambda}{r},$$

which in the example is $NA_{img}$=0.78/12.5=0.064 (F/7.8) with about 50 μm depth-of-focus.

Results:

Thus, the imaging system of the present invention provides increased resolution and efficiency over conventional laser printing architectures. For example, a system designed in accordance with the embodiments described above is capable of a resolution of 2000 dpi (dots per inch) at a printing speed of as much as about 2000 pages per minute (ppm). However, it will be understood that the actually printing speed is limited by non-LDSLM factors to about 60 letter-size ppm. With 1.5 μJ/$cm^2$ photoconductor sensitivity and with 30% laser-to-drum efficiency, the desired laser power is 3 mW. In one preferred embodiment, the LDSLM 205 has 16000 pixels, each of which is 3 μm wide, and the desired LDSLM pixel modulation speed to produce 1 letter-size/sec is 24 kHz. The illumination NA is 0.26, and the imaging NA is 0.064. The desired data flow to the printing head=$24\times10^3\times16{,}000\times8$ bits (for gray-scale)=3 Gbits/sec, for printing 60 pages/minute This example calculation demonstrates that a linear, diffractive MEMS LDSLM 205 can enable very high-speed laser printing with simple diode lasers and optics and standard-sensitivity photoconductive write drums. Further-more, the modulation speed of the LDSLM 205 can easily be increased by more than an order magnitude beyond the value of 24 kHz cited in the example calculation above. The data flow requirements between the PC and the printer are high (3 Gbits/sec) but certainly attainable with state-of-the-art technologies. It is additionally interesting to note that the maximum printing speed allowed by the LDSLM (~1 MHz) is ~2000 pages/min.

Multiple Laser-Beam Architecture

The printing speeds calculated can all be achieved with a printer capable of 8-bit gray-scale exposure using the low-power diode laser in CW operation. Therefore, the present invention is directed to a printing system having a LDSLM assembly and a multiple laser-beam optical architecture to effectively increase the laser-printer resolution by sequential tiling of $N_L$ images (on the printer photoconductive drum) from a single diffractive MEMS spatial light modulator illuminated by $N_L$ laser sources.

Two-Beam Illumination

Figure 7:
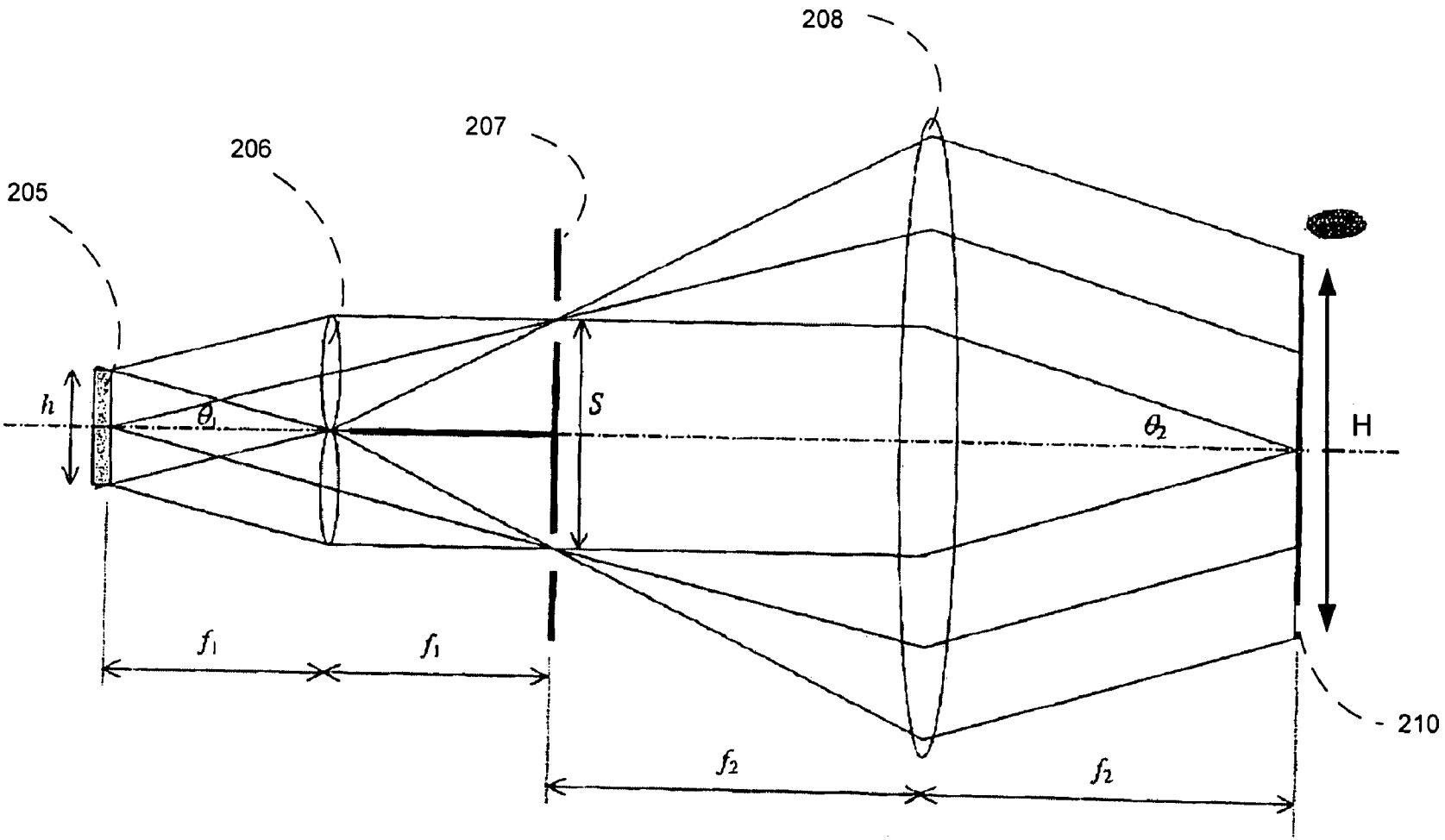
FIG. 7 is an optics diagram of an illumination system of a dual-laser printer architecture according to an embodiment of the present invention.

For simplicity, a system 700 having two laser illumination is illustrated in FIG. 7. FIG. 7 is an optics diagram of an imaging system of a dual-laser printer architecture according to an embodiment of the present invention.

1.1 Two-Beam Imaging: LDSLM-to-Drum

Given an LDSLM 202 of length h and the total length of the image on the drum 704 of H, the desired magnification is $$M = \frac{H}{2h} \tag{1}$$

The magnification is realized by the choice of the FT and FT−1 focal lengths, since $M=f_2/f_1$. It can be seen that there is only one parameter left to fix the system, which we will take to be the imaging optics length $L\equiv 2f_1+2f_2$. Solving, we obtain:

$$f_1 = \frac{L}{2(M+1)}, \quad f_2 = \frac{ML}{2(M+1)}, \tag{2}$$

The FT lenses (206 and 208) are placed at the location where the two beams start to separate. The desired illumination incident angle $\theta_1$ is $$\tan\theta_1 = \frac{h}{2f_1}. \tag{3}$$

The incident angle on the drum$\pm\theta_2$ is $$\tan\theta_2 = \frac{h}{f_2} = \frac{2\tan\theta_1}{M}. \tag{4}$$

Example #1

Given h=25 mm (5000 pixels, say), H=8" (total of 10,000 pixels to meet 1200 dpi), and L=400 mm, we find that M=H/2 h=4.

$f_1$=40 mm, $f_2$=160 mm $\theta_1$=17.4°, $\theta_2$=8.9° (L can be increased if these angles are too large)

Figure 8:
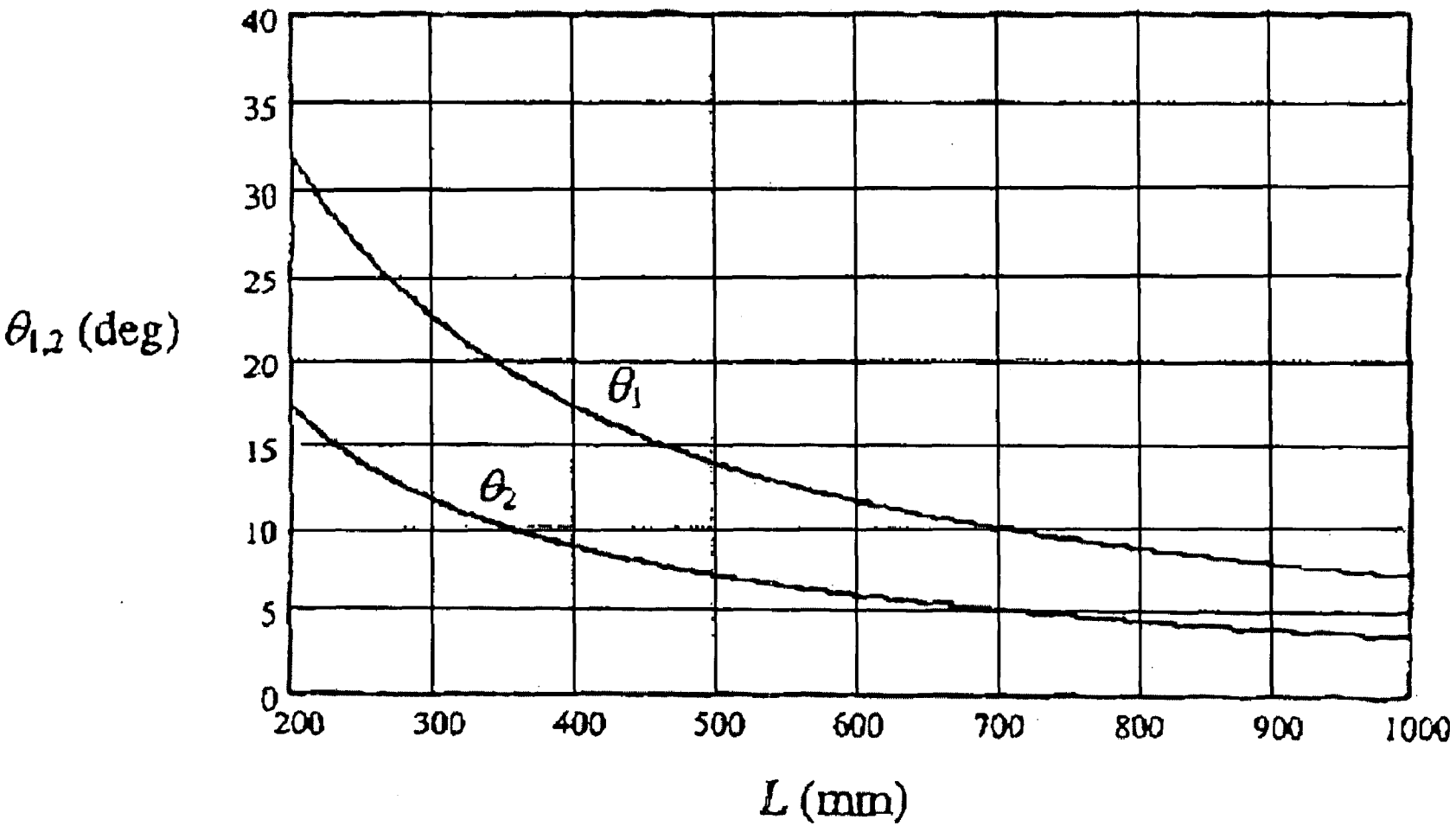
FIG. 8 illustrates graphs of the desired illumination incident angle $\theta_1$ on the LDSLM and the incident angle on the drum $\theta_2$ versus the imaging optics length for a dual-laser printer architecture according to an embodiment of the present invention.

The angles are not very small and it may raise some concerns (especially since the imaging is not telecentric). The dependencies of $\theta_1$ and $\theta_2$ on L is shown in FIG. 8. FIG. 8 illustrates graphs of the desired illumination incident angle $\theta_1$ and the incident angle on the drum $\theta_2$ versus the imaging optics length L for a dual-laser printer architecture according to an embodiment of the present invention. The value L~400-600 mm seems to be a good compromise. Beyond ~600 mm, increasing L has only small effect in reducing the angles.

1.2 Two-Beam Illumination: Laser-to-LDSLM

Figure 9:
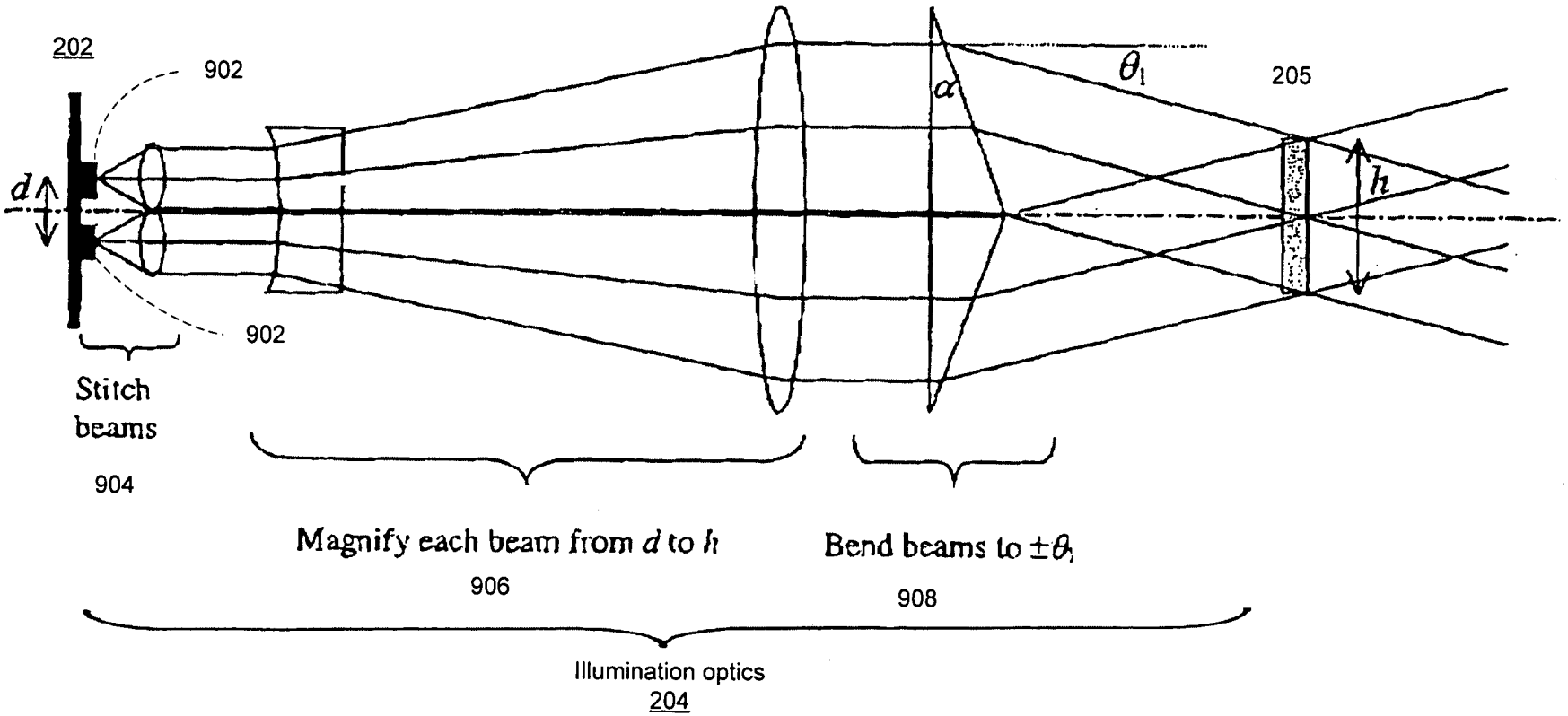
FIG. 9 is an optics diagram of an illumination system of a dual-laser printer architecture according to an embodiment of the present invention.

A two-beam laser to LDSLM system is illustrated in FIG. 9. FIG. 9 is an optics diagram of an illumination system 900 of a dual-laser printer architecture according to an embodiment of the present invention.

Assume a light source 202 comprising two point sources 902, such as two laser emitters or emitters on a single substrate or GaAs die. The two point sources 902 may be configured to be apart by a distance d. What is needed is an illumination system with two parameters to match the illumination width h and the incident angles of the two beams $\theta_1$ on the LDSLM 205. The example in FIG. 9 below has the advantage of decoupling the h and the $\theta_1$ parameters.

In this implementation, the illumination optics 204 is configured to stitch 904 the beams, magnify 906 each beam from d to h, and to bend 908 the two beams to plus $\theta_1$ and minus $\theta_1$. To bend the beam by $\theta_1$, the prism angle (see FIG. 9) is preferably $$\alpha=\sin^{-1}(n \sin \alpha)-\theta_1 \tag{5}$$

Example #2

Recall that from last the last example h=25 mm and $\theta_1$=17.4°:

If d=250 μm, the desired magnification is 100×. Further, the prism (index n=1.5) preferably has an α=9.25°.

Conclusion:

Thus, the imaging system of the present invention is uniquely defined by the LDSLM length h, the image width on the drum H and the imaging optics length L. The illumination system is uniquely defined by the laser emitter spacing d, the beam width h and the incident angles$\pm\theta_1$. Preferably, the illumination optics are simple, compact, robust, and cheap, for example from molded polymers or plastics.

Figure 10:
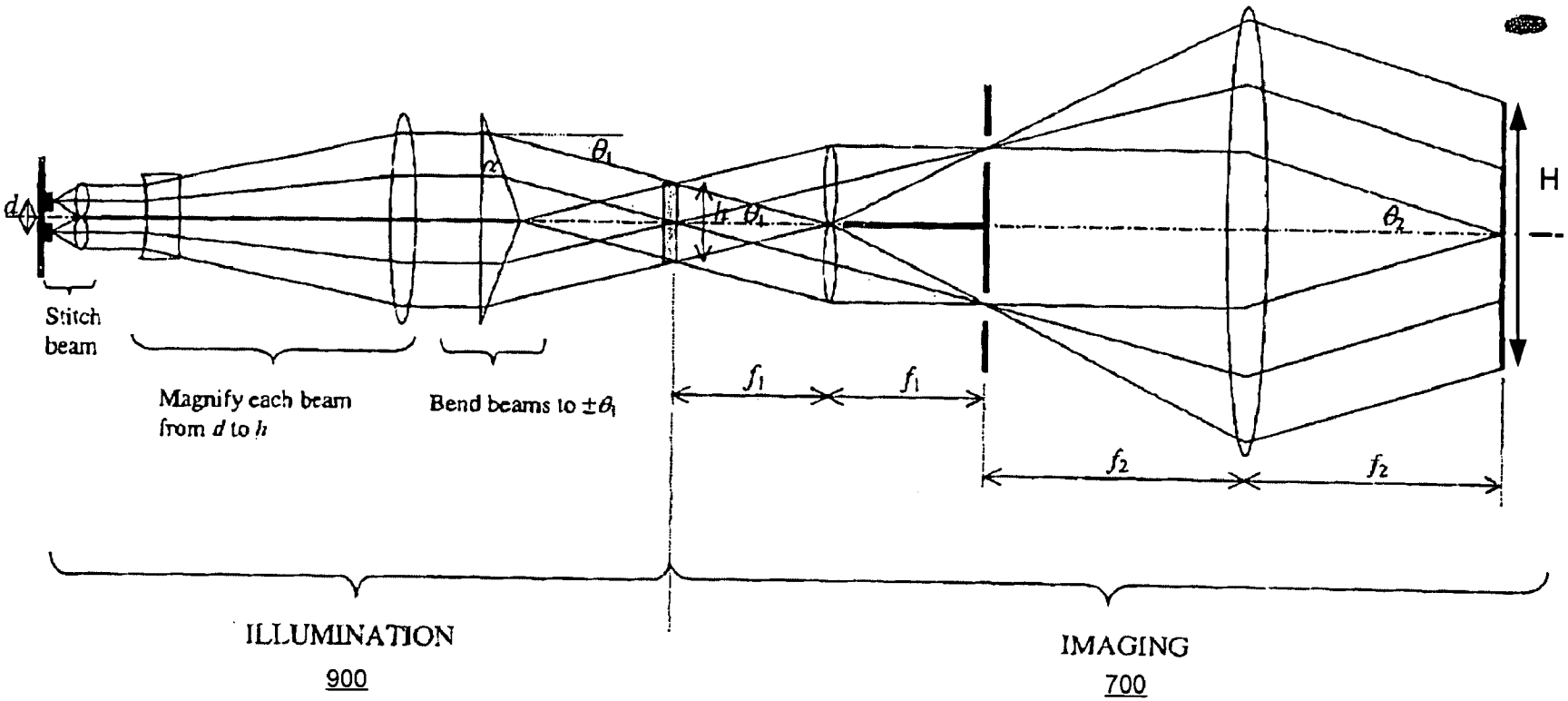
FIG. 10 is a complete optics diagram of a dual-laser printer architecture according to an embodiment of the present invention.

A complete optics diagram of an embodiment of a dual-laser printer architecture, including both the illumination 900 and imaging 700 systems is shown in FIG. 10.

2. Generalization to Multi-Beam Illumination

In yet another alternative embodiment, not shown, the illumination system can be a multi-beam illumination system including $N_L$ lasers, where $N_L$ is greater than two.

2.1 Multi-Beam Imaging

With $N_L$ lasers, a GLV of length h, and an image total length H on the drum, the required magnification is $$M = \frac{H}{N_L h}. \tag{6}$$

As before, there is only one parameter left to fix the system, which we will take to be the imaging optics length $L=2f_1+2f_2$. Solving, we obtain:

$$f_1 = \frac{L}{N_L(M+1)}, \quad f_2 = \frac{ML}{N_L(M+1)}, \tag{7}$$

The largest illumination incident angle $\theta_1$ is $$\tan\theta_1 = \frac{(N_L-1)h}{2f_1}, \tag{8}$$

and the incident angle on the drum$\pm\theta_2$ is:

$$\tan\theta_2 = \frac{(N_L-1)h}{f_2} = \frac{2\tan\theta_1}{M}. \tag{9}$$

Example:

Use $N_L$=3 with h=25 mm (5000 pixels, say), H=12" (total of 15 k pixels to meet 1200 dpi), and L=400 mm, we find that M=H/3 h=4×, $f_1$=36.4 mm, $f_2$=97.0 mm, $\theta_1$=34.5°, and $\theta_2$=27.3°. Increasing the optics train length to L=1 meter helps to bring the parameters down to $f_1$=90.9 mm, $f_2$=242.4 mm, $\theta_1$=15.4°, and $\theta_2$=11.7°.

Figure 11:
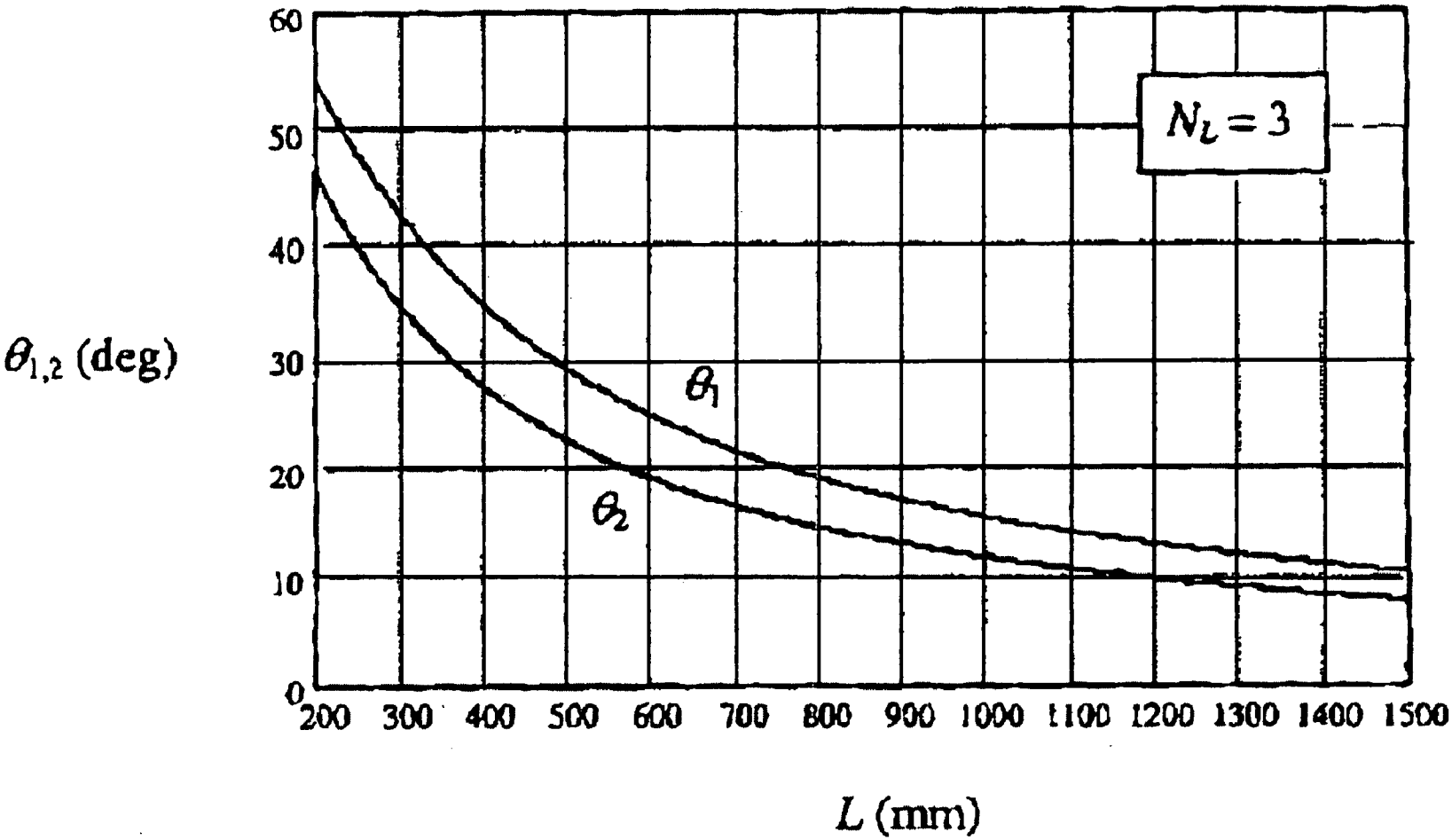
FIG. 11 illustrates graphs of the desired illumination incident angle $\theta_1$ and the incident angle on the drum $\theta_2$ versus the imaging optics length for a triple-laser printer architecture according to an embodiment of the present invention.

FIG. 11 illustrates graphs of the desired illumination incident angle $\theta_1$ and the incident angle on the drum $\theta_2$ versus the imaging optics length for a multi-laser printer architecture according to an embodiment of the present invention.

2.2 Multi-Beam Illumination

The design of this multi-beam illumination system is analogous to the two laser system described previously, but with the triangular prism replaced by a multi-faceted prism to deliver $N_L$ beams to the GLV with various incident angles between $-\theta_1$, and $+\theta_1$.

Conclusion:

Thus, the multi-beam illumination system of the present invention effectively increases printer resolution by sequential tiling of $N_L$ images (on the printer photoconductive drum) from a single LDSLM illuminated by $N_L$ laser sources. The illumination system is uniquely defined by the number of lasers $N_L$, the laser emitter spacing d, the GLV length h, the image width on the drum H and the imaging optics length L.

The foregoing description of specific embodiments and examples of the invention have been presented for the purpose of illustration and description, and although the invention has been described and illustrated by certain of the preceding examples, it is not to be construed as being limited thereby. They are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents.

What is claimed is:

1. A printing system comprising:

a laser source to generate a light beam;

a linear diffractive spatial light modulator assembly to diffract light from the laser source according to an applied electric field;

illumination optics for focusing the light beam onto the spatial light modulator assembly;

an image plane having a photosensitive surface;

imaging optics disposed in a light path between the spatial light modulator assembly and the image plane to expand the light beam and image the light beam simultaneously on a substantially linear portion of the photosensitive surface, wherein the imaging optics comprises (i) a Fourier transform lens configured such that light from each beam component converges around a corresponding point of a back focal plane of the Fourier transform lens, and (ii) an optical component for inverse Fourier transformation of light from the back focal plane to the image plane; and a drum covered by the photosensitive surface, wherein the drum is configured to rotate the photosensitive surface such that the substantially linear portion imaged by the light beam is scanned across an area of the photosensitive surface, wherein the laser source comprises an array of a plurality of laser emitters, and the illumination and imaging optics are configured to compose a corresponding plurality of images at the image plane, wherein the illumination optics comprises a plurality of lenses configured to stitch together beam components from the plurality of emitters to form the light beam, lenses configured to magnify each said beam component, and an optical component to bend said beam components so that said beam components are incident to the spatial light modulator assembly at different incident angles.

2. The printing system according to claim 1, wherein the linear diffractive spatial light modulator assembly comprises a linear array of diffractive MEMS elements.

3. The printing system according to claim 2, wherein each the diffractive MEMS elements comprises a plurality of deformable ribbons having a light reflective planar surface.

4. The printing system according to claim 3, wherein the linear diffractive spatial light modulator assembly comprises a linear array of diffractive MEMS elements grouped in a number of pixels, and wherein each of the diffractive MEMS elements in a single pixel share a common ribbon structure.

5. The printing system according to claim 4, wherein each of the diffractive MEMS elements further comprise a substrate having a reflective surface over which the plurality of deformable ribbons are positioned, and wherein the common ribbon structure in each of the diffractive MEMS elements in a single pixel share have a plurality of openings in a middle portion to allow light to pass through and impinge on the reflective surface.

6. The printing system according to claim 5, wherein at least one opening of the plurality of openings comprises a rectangular slot.

7. The printing system according to claim 3, wherein each of the diffractive MEMS elements further comprise a substrate on which the plurality of deformable ribbons, and wherein drive electronics to apply an electric field to the plurality of deformable spaced apart ribbons is integrally formed in the substrate.

8. The printing system according to claim 2, wherein the linear diffractive spatial light modulator assembly comprises a plurality of linear arrays of diffractive MEMS elements.

9. A printing system comprising:

a laser source to generate a light beam;

a linear diffractive spatial light modulator assembly to diffract light from the laser source according to an applied electric field;

illumination optics for focusing the light beam onto the spatial light modulator assembly;

an image plane having a photosensitive surface;

imaging optics disposed in a light path between the spatial light modulator assembly and the image plane to expand the light beam and image the light beam simultaneously on a substantially linear portion of the photosensitive surface, wherein the imaging optics comprises (i) a Fourier transform lens configured such that light from each beam component converges around a corresponding point of a back focal plane of the Fourier transform lens, (ii) an optical component for inverse Fourier transformation of light from the back focal plane to the image plane, wherein the optical component for inverse Fourier transformation of light comprises an inverse Fourier transform mirror, and (iii) a filter positioned at the back focal plane; and a drum covered by the photosensitive surface, wherein the drum is configured to rotate the photosensitive surface such that the substantially linear portion imaged by the light beam is scanned across an area of the photosensitive surface.

10. A method of printing comprising:

emitting a light beam;

focusing the light beam onto a linear diffractive spatial light modulator;

diffracting the light beam by controllably diffractive elements of the linear diffractive spatial light modulator according to an applied field at each element; and imaging the light beam from the spatial light modulator to a substantially linear portion of a photosensitive surface at an image plane, wherein said imaging includes both forward and inverse Fourier transformations of light; and a drum covered by the photosensitive surface, wherein the drum is configured to rotate the photosensitive surface such that the substantially linear portion imaged by the light beam is scanned across a two-dimensional area of the photosensitive surface, wherein the emitted light beam comprises beam components emitted by a plurality of laser emitters, and the focusing of the light beam onto the spatial light modulator comprises magnifying each beam component and bending the beam components to different incident angles.

11. The method according to claim 10, wherein the imaging of the light beam includes using a Fourier transform lens configured such that light from each beam component converges around a corresponding point of a back focal plane of the Fourier transform lens.

12. The method according to claim 11, wherein the imaging of the light beam further includes applying a filter positioned at said back focal plane.

13. The method according to claim 12, wherein the imaging of the light beam further includes using an optical component for inverse Fourier transformation of light from said back focal plane to the substantially linear portion of the photosensitive surface.

* * * * *